US006138869A

United States Patent [19]

DiSanto

[11] Patent Number: 6,138,869

[45] **Date of Patent: *Oct. 31, 2000**

[54] WATER DISPENSING SYSTEM

[75] Inventor: Timothy J. DiSanto, Modesto, Calif.

[73] Assignee: Pure Fill Corporation, Modesto, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/073,153

[22] Filed: May 5, 1998

Related U.S. Application Data

[63] Continuation of application No. 08/722,610, Sep. 27, 1996, Pat. No. 5,782,380.

[51] Int. Cl.[7] ..... B67D 5/10

[52] U.S. Cl. ..... 222/2; 222/111; 222/129; 141/369; 312/136

[58] Field of Search ..... 222/2, 109, 111, 222/129.1, 129, 182; 141/369; 312/114, 128, 136, 138.1, 327, 313

[56] References Cited

U.S. PATENT DOCUMENTS

| | | | |
|---|---|---|---|
| D. 182,277 | 3/1958 | Giepen et al. | D52/3 |
| D. 197,482 | 2/1964 | Boldt et al. | D52/3 |
| D. 206,400 | 12/1966 | Williams | D52/3 |
| D. 207,791 | 5/1967 | Stein | D52/3 |
| D. 209,084 | 10/1967 | Moore | D52/3 |
| D. 212,258 | 9/1968 | Cornellus et al. | D52/3 |
| D. 222,704 | 12/1971 | Winsett | D52/3 |
| D. 235,388 | 6/1975 | Taylor | D94/3 B |
| D. 245,608 | 8/1977 | Murphy | D15/115 |
| D. 250,536 | 12/1978 | Bourke | D15/116 |
| D. 262,030 | 11/1981 | Reece | D15/111 |
| D. 262,894 | 2/1982 | Moore et al. | D20/4 |
| D. 271,496 | 11/1983 | Lents | D15/80 |
| D. 282,084 | 1/1986 | Koch | D20/1 |
| D. 283,827 | 5/1986 | Albright | D20/4 |
| D. 291,896 | 9/1987 | Stover | D20/5 |
| D. 294,105 | 2/1988 | Mathews | D7/307 |
| D. 294,271 | 2/1988 | Glaser | D20/4 |
| D. 296,449 | 6/1988 | Lövbrand | D20/4 |
| D. 304,407 | 11/1989 | Fossella | D7/308 |
| D. 313,331 | 1/1991 | Schroeder et al. | D7/308 |
| D. 324,464 | 3/1992 | Credle Jr. et al. | D7/308 |
| D. 331,264 | 11/1992 | Ellis | D20/1 |
| D. 343,332 | 1/1994 | Schroeder et al. | D7/308 |
| D. 361,239 | 8/1995 | DiSanto | D7/308 |
| D. 364,771 | 12/1995 | DiSanto | D7/307 |
| 449,024 | 3/1891 | Allin . | |
| 494,061 | 3/1893 | Day . | |
| 1,026,635 | 5/1912 | Tomlinson . | |
| 1,300,285 | 4/1919 | McDonald . | |
| 1,655,090 | 1/1928 | Cunningham . | |
| 1,702,213 | 3/1929 | Cordley . | |
| 1,702,560 | 2/1929 | Ebinger . | |
| 1,723,305 | 8/1929 | Sipe . | |

(List continued on next page.)

FOREIGN PATENT DOCUMENTS

| | | |
|---|---|---|
| 170933 | 1/1951 | Canada . |

OTHER PUBLICATIONS

Photographs with accompanying statement.

Stover, D., "Radar on a Chip", *Popular Science*, pp. 107–110, 116–117 (Mar. 1995).

*Primary Examiner*—Kenneth Bomberg

*Attorney, Agent, or Firm*—Michael D. Rechtin; Foley & Lardner

[57] ABSTRACT

A water dispenser comprising a plurality of water filling stations located side by side in a single sink. Each station includes an intermediate shelf. A filling station is coupled to each of the stations and selectively provides one of a plurality of predetermined water volumes with a single actuation.

6 Claims, 5 Drawing Sheets

U.S. PATENT DOCUMENTS

| | | | |
|---|---|---|---|
| 2,043,856 | 6/1936 | Knapp | 225/1 |
| 2,249,299 | 7/1941 | Rocco | 225/1 |
| 2,307,589 | 1/1943 | Johnson | 225/21 |
| 2,362,104 | 11/1944 | Smith | 225/40 |
| 2,583,461 | 1/1952 | Arnett | 225/21 |
| 2,749,164 | 6/1956 | Kitzelman | 292/121 |
| 2,753,583 | 2/1956 | Misch | 222/129 |
| 2,754,998 | 7/1956 | Doepke et al. | 222/129 |
| 2,774,393 | 12/1956 | Swan | 141/18 |
| 2,831,609 | 4/1958 | Montbriand et al. | 222/76 |
| 3,015,415 | 1/1962 | Marsh et al. | 222/14 |
| 3,021,685 | 2/1962 | Gore et al. | 62/89 |
| 3,185,348 | 5/1965 | Pollak et al. | 222/129.1 |
| 3,207,281 | 9/1965 | Norris, Jr. | 194/13 |
| 3,207,282 | 9/1965 | Norris, Jr. | 194/13 |
| 3,221,859 | 12/1965 | Mcabee . | |
| 3,311,992 | 4/1967 | Seley | 34/57 |
| 3,334,953 | 8/1967 | Becker | 312/253 |
| 3,375,913 | 4/1968 | Norris, Jr. | 210/262 |
| 3,382,897 | 5/1968 | Skiera et al. | 141/107 |
| 3,446,046 | 5/1969 | Randel | 70/101 |
| 3,508,504 | 4/1970 | Kotler | 109/59 |
| 3,665,736 | 5/1972 | Wilson | 70/78 |
| 3,680,937 | 8/1972 | Steeley | 312/138 |
| 3,744,834 | 7/1973 | Poe | 292/302 |
| 3,752,520 | 8/1973 | Sprick et al. | 292/148 |
| 3,856,676 | 12/1974 | Grimme, Jr. et al. | 210/96 |
| 3,930,698 | 1/1976 | Colgan | 312/43 |
| 3,951,303 | 4/1976 | Hobden et al. | 221/96 |
| 4,031,722 | 6/1977 | Michelman et al. | 70/63 |
| 4,135,375 | 1/1979 | Voegeli | 70/77 |
| 4,145,291 | 3/1979 | Console et al. | 210/232 |
| 4,152,910 | 5/1979 | Swisher | 70/159 |
| 4,160,727 | 7/1979 | Harris, Jr. | 210/23 |
| 4,174,872 | 11/1979 | Fessler | 312/290 |
| 4,194,775 | 3/1980 | Shea | 292/307 |
| 4,227,388 | 10/1980 | Nigrelli et al. | 70/427 |
| 4,235,352 | 11/1980 | Newman et al. | 222/129 |
| 4,258,501 | 3/1981 | Brown | 47/16 |
| 4,262,503 | 4/1981 | Kuebler | 70/101 |
| 4,316,557 | 2/1982 | Benoun et al. | 222/129.1 |
| 4,318,772 | 3/1982 | Kragh | 159/45 |
| 4,347,704 | 9/1982 | Marquardt et al. | 60/648 |
| 4,350,032 | 9/1982 | Kochackis | 70/427 |
| 4,399,672 | 8/1983 | Moorhouse | 70/101 |
| 4,418,551 | 12/1983 | Kochackis | 70/18 |
| 4,501,381 | 2/1985 | Hart | 222/2 |
| 4,512,377 | 4/1985 | Greer | 141/11 |
| 4,528,093 | 7/1985 | Winer | 210/96.2 |
| 4,548,060 | 10/1985 | Campbell | 70/91 |
| 4,585,554 | 4/1986 | Burrows | 210/110 |
| 4,597,509 | 7/1986 | Pereira | 222/129 |
| 4,599,166 | 7/1986 | Gesslauer | 210/96.1 |
| 4,623,467 | 11/1986 | Hamlin | 210/652 |
| 4,658,872 | 4/1987 | Ellis | 141/311 |
| 4,735,750 | 4/1988 | Damann | 261/29 |
| 4,741,454 | 5/1988 | Ray et al. | 220/315 |
| 4,770,700 | 9/1988 | Bertha et al. | 75/101 R |
| 4,801,375 | 1/1989 | Padilla | 210/100 |
| 4,823,570 | 4/1989 | Jurek | 70/129 |
| 4,842,723 | 6/1989 | Parks et al. | 210/95 |
| 4,843,853 | 7/1989 | Robert et al. | 70/427 |
| 4,852,621 | 8/1989 | Bear | 141/83 |
| 4,857,184 | 8/1989 | DeLoach | 210/128 |
| 4,898,678 | 2/1990 | Johnson et al. | 210/741 |
| 4,946,599 | 8/1990 | Craig | 210/741 |
| 4,958,747 | 9/1990 | Sheets | 222/67 |
| 4,969,991 | 11/1990 | Valadez | 210/96.2 |
| 4,993,247 | 2/1991 | Minemura | 70/208 |
| 4,997,553 | 3/1991 | Clack | 210/97 |
| 5,002,664 | 3/1991 | Clack et al. | 210/251 |
| 5,064,097 | 11/1991 | Brog et al. | 222/129 |
| 5,072,590 | 12/1991 | Burrows | 62/3.64 |
| 5,096,590 | 3/1992 | Watanabe et al. | 210/644 |
| 5,108,590 | 4/1992 | DiSanto | 210/97 |
| 5,112,477 | 5/1992 | Hamlin | 222/146.6 X |
| 5,120,447 | 6/1992 | Christian | 210/714 |
| 5,128,035 | 7/1992 | Clack et al. | 210/251 |
| 5,147,532 | 9/1992 | Leek, Jr. | 210/97 |
| 5,152,429 | 10/1992 | Billings | 222/129.2 |
| 5,184,476 | 2/1993 | Desrosiers et al. | 62/389 |
| 5,192,004 | 3/1993 | Burrows | 222/146.1 |
| 5,197,314 | 3/1993 | Stillwagon et al. | 70/386 |
| 5,213,597 | 5/1993 | Campbell | 55/385.1 |
| 5,246,141 | 9/1993 | Burrows | 222/146.1 |
| 5,373,874 | 12/1994 | Shieh | 222/129.1 X |
| 5,492,250 | 2/1996 | Sardynski | 222/108 |
| 5,507,329 | 4/1996 | Shub | 222/129.1 X |
| 5,582,717 | 12/1996 | DiSanto | 222/198.06 X |
| 5,782,380 | 7/1998 | DiSanto | 222/129 X |

WATER DISPENSING SYSTEM

This application is a continuation of application Ser. No. 08/722,610, filed Sep. 27, 1996, now U.S. Pat. No. 5,782, 380, issued Jul. 21, 1998.

BACKGROUND OF THE INVENTION

The present invention relates generally to water dispensers. More particularly, the present invention relates to dispensing purified water with a compact, easy to use coin-operated machine.

Many grocery stores feature coin operated vending machines which dispense purified drinking water. The customers bring a bottle to the machine, place it in the vending station, and then insert coins into the machine to actuate the water dispenser. The machine then dispenses a single predetermined quantity of water which may not fill the bottle. Generally, these water dispensers fill one container at a time. If more than one station is required, the service provider must supply expensive additional machines, and surrender additional space to water dispensing services. Therefore, the cost of providing this service is increased significantly. Although some prior art devices contain multiple filling stations, these are much larger than single water dispensing units, and therefore also require a great deal of space.

It is therefore an object of the invention to provide a self service water dispenser which efficiently utilizes space.

It is a further object of the present invention to provide a self service water dispenser that dispenses a plurality of water volumes upon actuation of a single button, lever or similar device.

It is a still further object of the invention to provide a self service water dispenser that provides a plurality of filling stations in a compact and attractive configuration.

Other advantages and features of the invention, together with the organization and manner of operation thereof, will become apparent from the following detailed description when taken in conjunction with the accompanying drawings, wherein like elements have like numerals throughout the drawings.

DETAILED DESCRIPTION OF PREFERRED EMBODIMENTS

Figure 1:
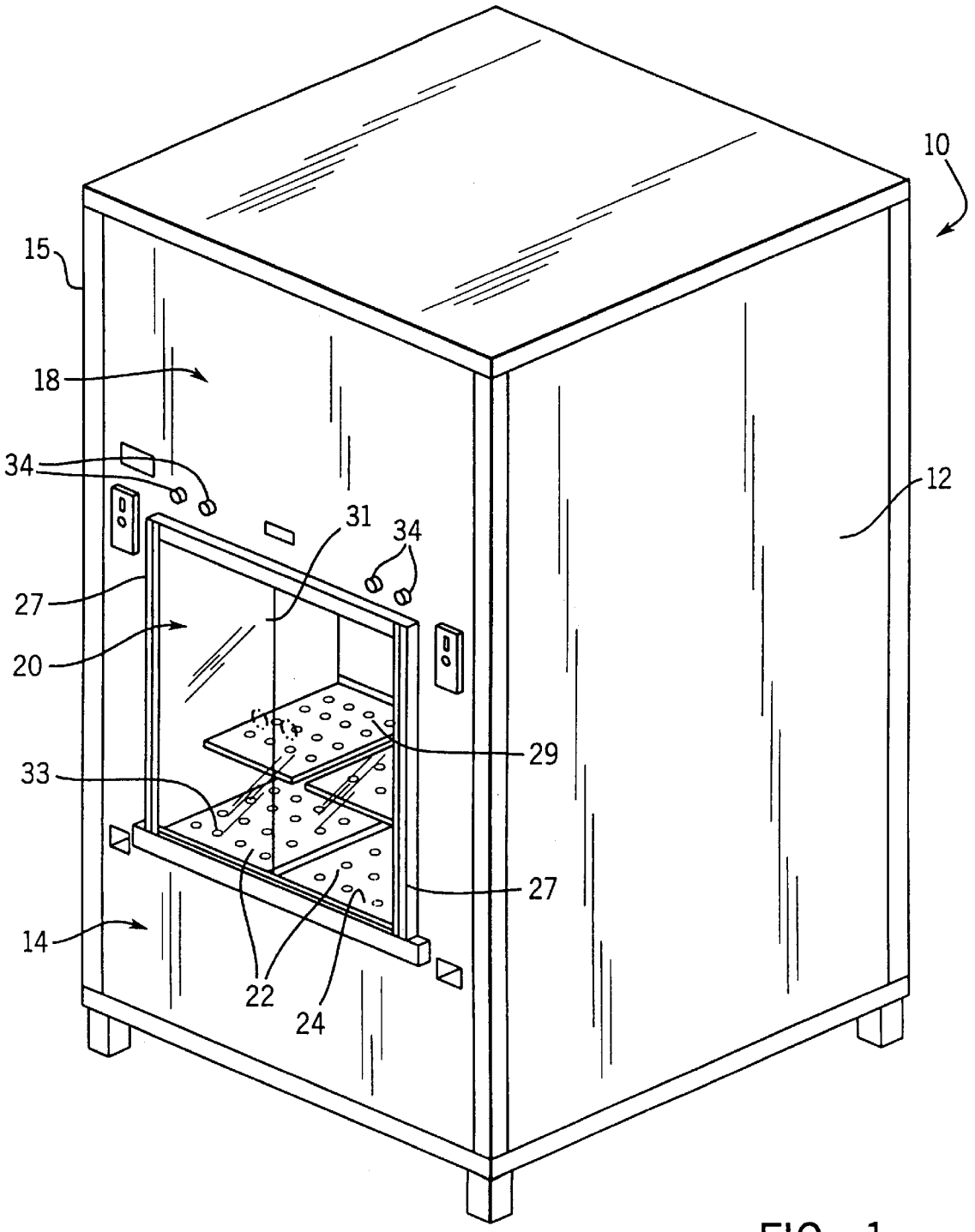
FIG. 1 illustrates a perspective view of a water dispenser constructed in accordance with one form of the invention.
Figure 2:
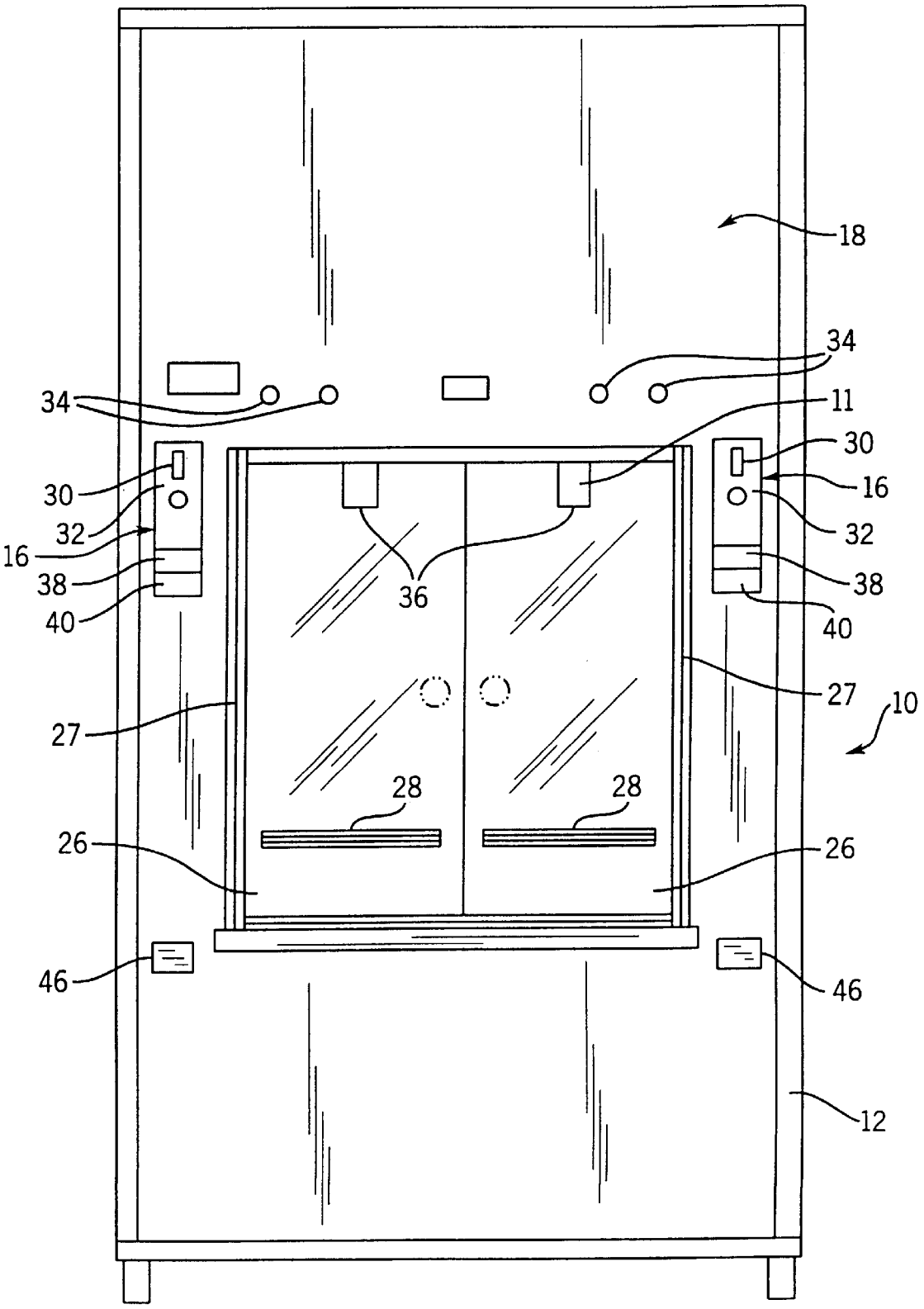
FIG. 2 shows a front view of the water dispenser shown in FIG. 1.
Figure 3:
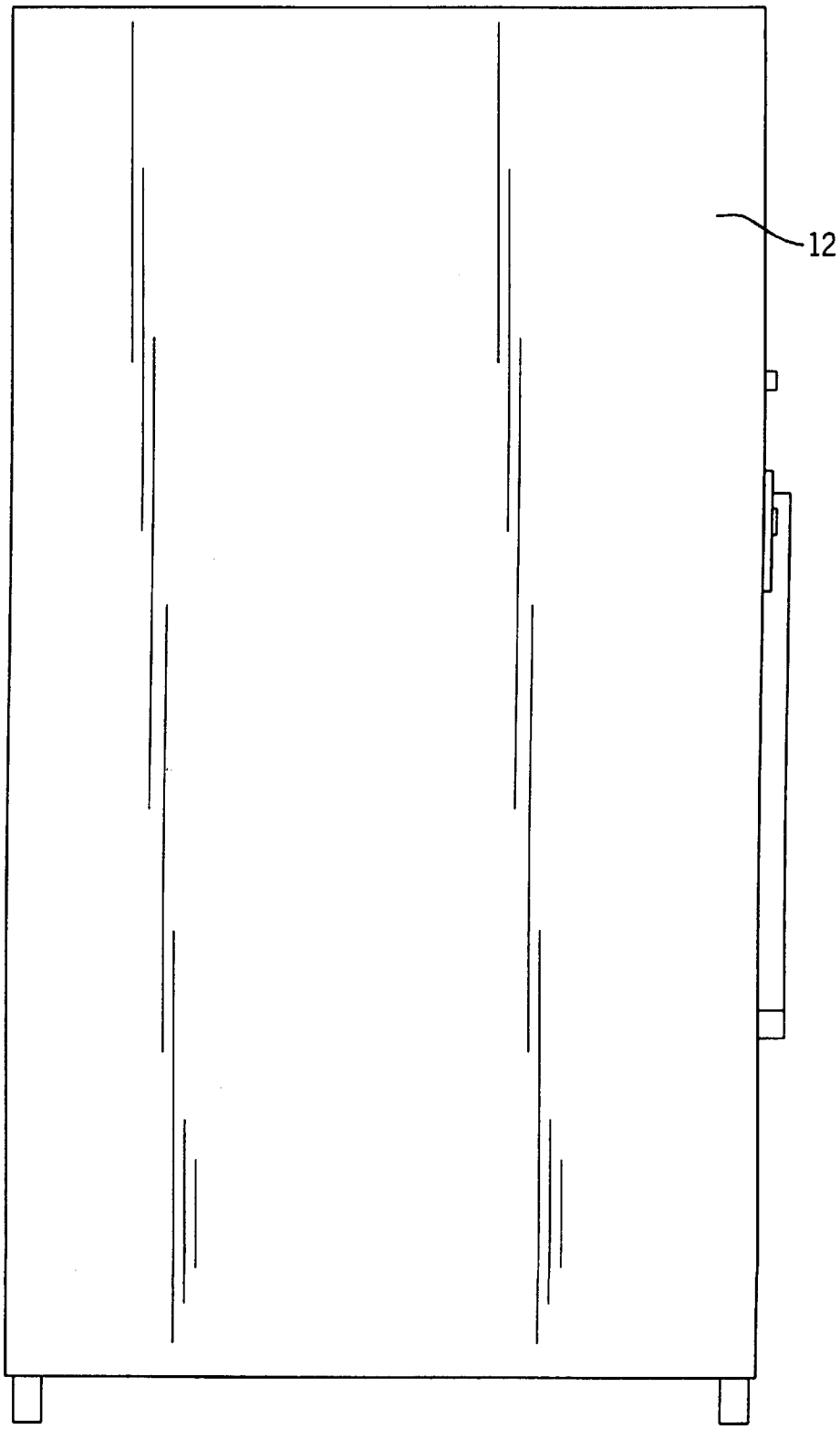
FIG. 3 illustrates a side view of the water dispenser shown in FIGS. 1 and 2.
Figure 4:
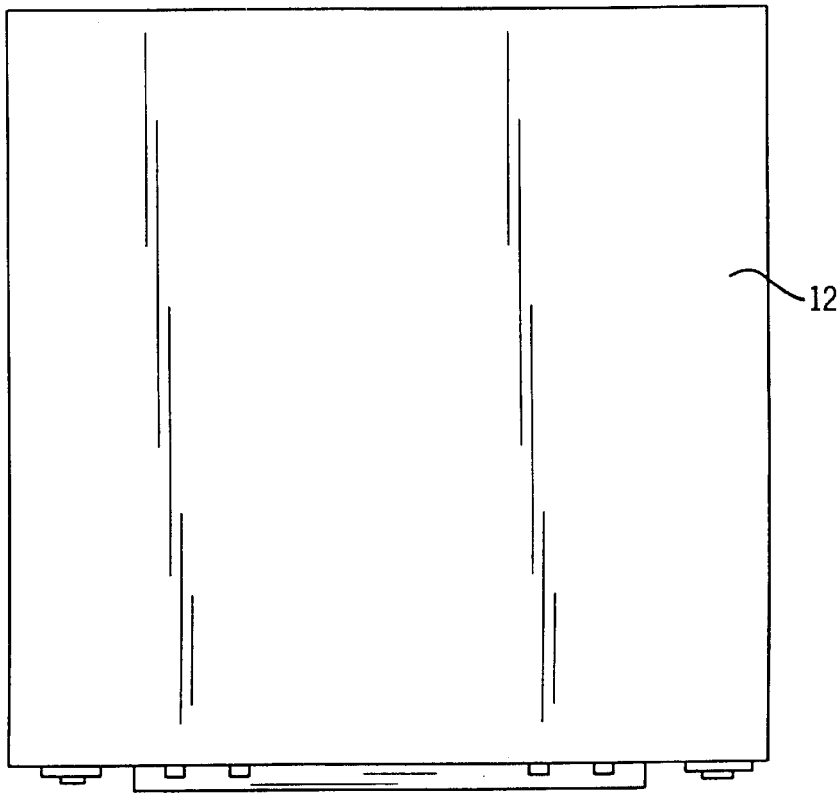
FIG. 4 shows a top view of the water dispenser shown in FIGS. 1–3.
Figure 5:
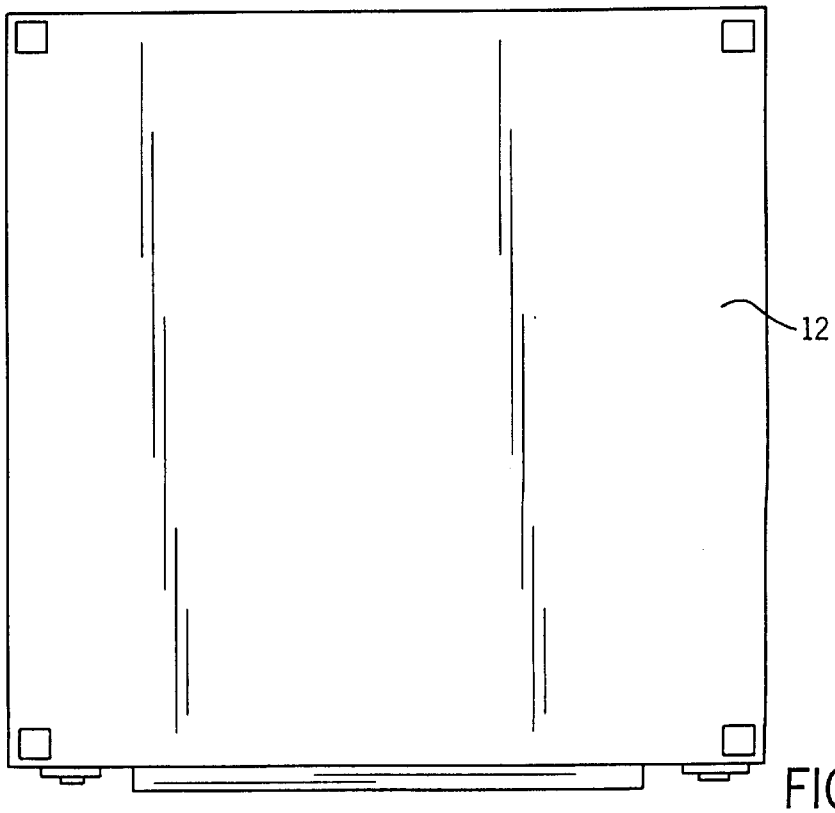
FIG. 5 illustrates a bottom view of the water dispenser shown in FIGS. 1–4.
Figure 6:
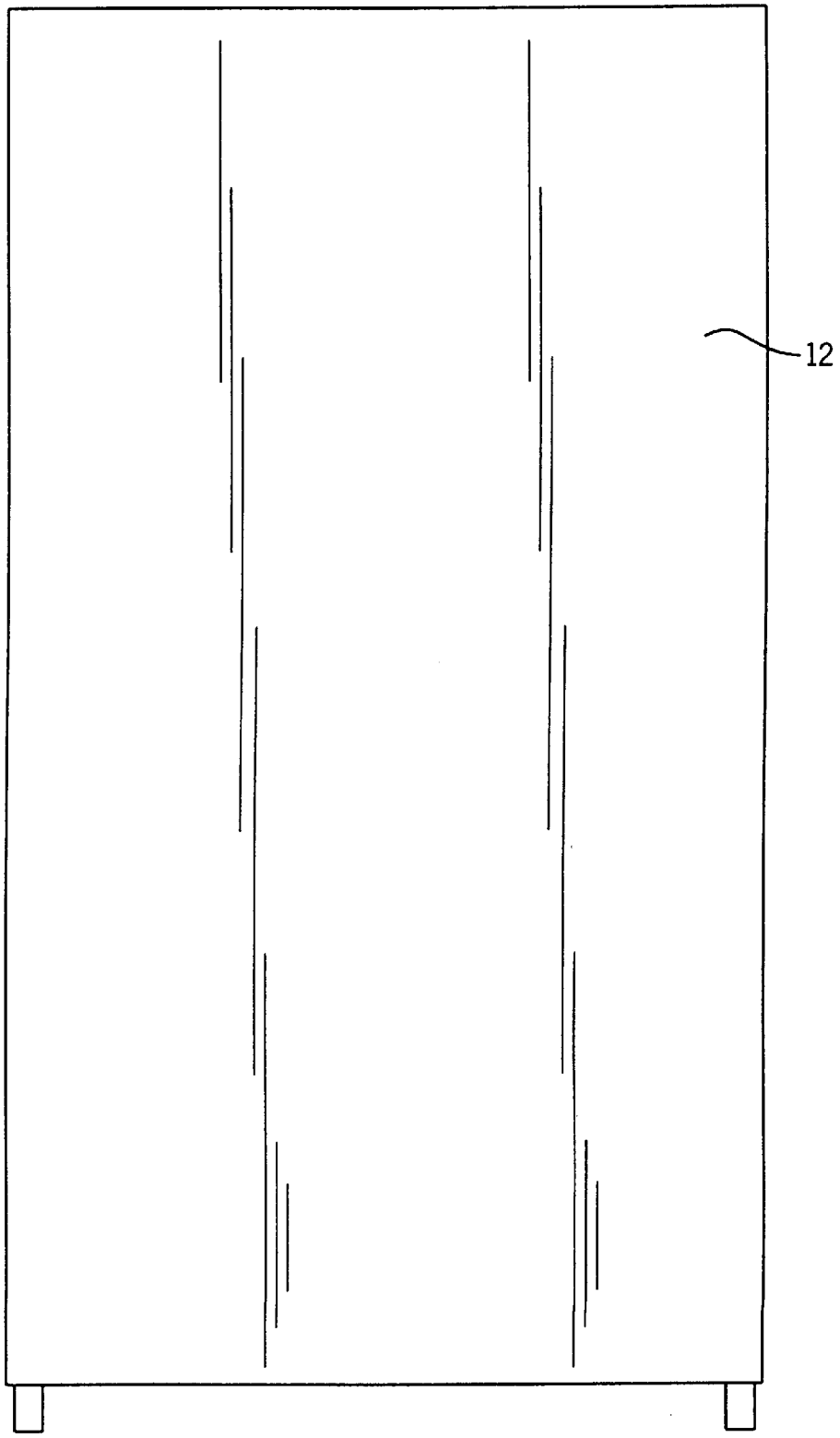
FIG. 6 shows a back view of the water dispenser shown in FIGS. 1–5.

Referring to the Figures, and more particularly to FIG. 1, a water dispenser constructed in accordance with one preferred embodiment of the invention is shown at 10. While a variety of products can be dispensed in accordance with the invention, preferably water is dispensed as described herein. The water dispenser 10 preferably comprises a cabinet 12 for housing a water supply and filtration system 11. The cabinet 12 further comprises a cabinet panel 14 which includes a coin operation system 16, at least one display area 18, and an aperture 20 in the cabinet panel 14 which provides access to a plurality of filling stations 22.

The water supply and filtration system 11 is operated using coin operation system 16, which is coupled to the cabinet 12 in a conventional manner. The filling stations 22 are preferably located side by side inside the aperture 20 above a single sink 24. Because all filling stations 22 can use the same sink 24, the water dispenser 10 can be constructed in the same cabinet as a single water dispenser system, thereby reducing manufacturing costs and required floor space.

Access to the filling stations 22 is provided by at least one pivotable door 26 located near and preferably covering the aperture 20. When the pivotable door 26 is opened, the user gains access to an intermediate shelf 28. The intermediate shelf 28 provides a location at which the user can place a relatively small empty container to be filled. Alternatively, the intermediate shelf 28 can be pivoted or otherwise conventionally moved out of the way to enable placement and filling of a larger container.

To fill the container, the user must insert money into the coin operation system 16. This money can be put in either the coin input slot 30 or the dollar input slot 32, which accepts paper money. After payment has been made, the user selects the amount of water to be dispensed preferably by pushing one of a plurality of actuating devices such as buttons 34 for actuating dispensing of a like plurality of volumes of water. The buttons 34 are located above the aperture 20 and the pivotable access doors 26. While two buttons 34 are shown for each filling station 22, it is understood that any plurality of fill select buttons 34 can be used. Alternatively, a single button 34 or other actuating device can be used in conjunction with a dial or other device to select and dispense the desired volume of water.

When the button 34 is selected, the water dispenser 10 actuates a filling apparatus 36 in fluid communication with the water supply and filtration system 11. The filling apparatus 36 is located above the intermediate shelf 28 and begins the dispensation of water after the filling apparatus 36 is actuated. The amount of water dispensed is determined by which button 34 is actuated. When the predetermined amount of water has been dispensed, the water dispenser 10 deactivates the filling apparatus 36 in a conventional manner. The user can then remove the container from the filling station 22. If the user has inserted more money than required, a coin return system 38 activates an electronic solenoid 40 to return the correct change. The electronic solenoid 40 minimizes the size of the coin operation system 16 so it is possible to install one coin operation system for each filling station 22.

The layout of the cabinet 12 is critical to the water dispensing business. If the cabinet is not laid out in an attractive and easy to use configuration, sales will be lost. Because water containers are heavy when filled, the aperture 20 is preferably located at a height convenient for loading and unloading heavy objects. The aperture 20 is preferably sized to allow easy insertion of containers that can hold up to about five gallons of water.

The display area 18 is preferably dimensioned large enough to be readily seen from fifty feet or more away to draw customers to the dispenser 10. The inventor has found that dimensioning the cabinet 12 such that its height (without legs) is bout 1.75 to 2 times its width, and the aperture 20 is square or slightly taller than it is wide provides a useful configuration. Further, locating the center of the aperture 20 at or preferably below the center of the cabinet 12 facilitates unloading heavy containers while providing a larger display area 18. Additionally, the coin operation systems 16 are preferably mounted substantially horizontally adjacent to and on opposing sides of the aperture 20. However, standard coin operation systems do not work in this configuration. Accordingly, in accordance with one preferred embodiment of the invention, the coin operation system 16 is electronically assisted. This electronic assistance can be provided in a number of ways, but preferably an electronic solenoid is used to actuate the coin basis. This allows the coin operation system to be mounted in a vertical configuration, enabling coins return apertures 46 to be located substantially vertically under the rest of the coin operation system.

In accordance with a method of use of the invention, the user opens one or more of the suitable access doors 26 and places one or more container in the aperture 20. Next, the user inserts coins or paper money into the coin operation system 38. This enables the water filling station 22 to dispense water when a button 34 is depressed.

While preferred embodiments have been illustrated and described, it should be understood that changes and modifications can be made thereto without departing from the invention in its broader aspects. Various features of the invention are defined in the following claims.

I claim:

1. A water dispenser comprising:

a cabinet including a cabinet panel;

a water supply and dispenser system disposed in the cabinet;

an aperture in the cabinet panel;

a plurality of filling stations disposed in the aperture;

a plurality of intermediate shelves disposed in the aperture, each of the intermediate shelves having a first position to hold a short container and a second position to clear a tall container;

a pivotable door connected to the cabinet panel so as to cover the aperture; and a coin operation system controlling operation of each of the plurality of filling stations to fill a short container, a tall container, a plurality of short containers, a plurality of tall containers or a mixture of short and tall containers.

2. The water dispenser of claim 1 comprising in addition a display area connected to the cabinet panel.

3. The water dispenser of claim 1 comprising in addition a sink disposed below the filling stations.

4. A water dispenser comprising:

a cabinet including a cabinet panel;

a water supply and dispenser system disposed in the cabinet;

an aperture in the cabinet panel;

a pair of filling stations disposed in the aperture;

a pair of intermediate shelves disposed in the aperture, each one of the pair of intermediate shelves having a first position to hold a short container and a second position to clear a tall container;

a pivotable door connected to the cabinet panel so as to cover the aperture; and a coin operation system controlling operations of each of the pair of filling stations to fill a short container, a tall container, two tall containers, two short containers, or a tall container and a short container.

5. The water dispenser of claim 4 comprising in addition a display area connected to the cabinet panel.

6. The water dispenser of claim 4 comprising in addition a sink disposed below the pair of filling stations.

* * * * *